US009695568B2

(12) United States Patent
Lewis

(10) Patent No.: US 9,695,568 B2
(45) Date of Patent: Jul. 4, 2017

(54) PERMANENT SHALLOW FROST PROTECTED FOOTING FOUNDATION FOR A BUILDING AND METHOD FOR CONSTRUCTING A FOUNDATION INCLUDING A PERMANENT SHALLOW FROST PROTECTED FOOTING

(71) Applicant: David L. Lewis, Bethlehem, CT (US)

(72) Inventor: David L. Lewis, Bethlehem, CT (US)

( * ) Notice: Subject to any disclaimer, the term of this patent is extended or adjusted under 35 U.S.C. 154(b) by 134 days.

(21) Appl. No.: 14/732,699

(22) Filed: Jun. 6, 2015

(65) Prior Publication Data

US 2015/0267374 A1 Sep. 24, 2015

Related U.S. Application Data

(62) Division of application No. 13/796,953, filed on Mar. 12, 2013, now Pat. No. 9,074,336.

(51) Int. Cl.

| | |
|---|---|
| ***E02D 27/01*** | (2006.01) |
| ***E02D 27/00*** | (2006.01) |
| ***E04G 13/00*** | (2006.01) |

(52) U.S. Cl.

CPC ..... *E02D 27/013* (2013.01); *E02D 27/00* (2013.01); *E04G 13/00* (2013.01); *E02D 2200/1664* (2013.01); *E02D 2250/0023* (2013.01)

(58) Field of Classification Search

CPC ..... E02D 27/00; E02D 27/013; E02D 27/01; E02D 27/35; E02D 2200/1664; E02D 2250/0023; E04G 13/00; E04G 17/005; E04G 9/10; E04G 9/05; E04G 11/02; E04G 11/06; E04G 11/365; E04G 17/0658; E04G 17/0754; E04G 17/0721; E04B 1/16; E04B 1/164; E04B 1/167; E04B 2/86; E04B 2/8005; E04B 5/32; E04B 5/36; E04C 1/40

See application file for complete search history.

(56) References Cited

U.S. PATENT DOCUMENTS

| | | | | |
|---|---|---|---|---|
| 3,421,278 | A | 1/1969 | Christ-Janer | |
| 3,977,646 | A | 8/1976 | Moon et al. | |
| 5,224,321 | A * | 7/1993 | Fearn | E02D 27/02 52/250 |
| 5,367,845 | A | 11/1994 | Hartling | |
| 5,398,351 | A * | 3/1995 | Watson | E04H 4/06 4/506 |

(Continued)

*Primary Examiner* — Jessica Laux

(74) *Attorney, Agent, or Firm* — Ware, Freesola, Maguire & Barber LLP

(57) ABSTRACT

A permanent frost protected shallow foundation footing for a building is assembled from a plurality of form parts arranged in a chain that is partially below ground level to form a foundation perimeter. The form parts are made of a lightweight material such as insulating foam material shaped as an elongated sectional unit with an overhang part overhanging a cavity part of an interior cavity. The interior cavity has an opening for receiving a concrete pour concurrent with a concrete pour of a floor. Open ends of the assembled sectional units abut each other in end-to-end alignment to form an elongated cavity inside the perimeter chain of form parts that is filled with concrete. The overhang part may have a foot shape that fits inside the interior cavity of another form part that may also have a foot shape for compact storage or transport prior to assembly.

2 Claims, 14 Drawing Sheets

(56) References Cited

U.S. PATENT DOCUMENTS

| | | | | |
|---|---|---|---|---|
| 5,399,050 | A * | 3/1995 | Jacobus | E04F 17/00 249/13 |
| 5,475,950 | A * | 12/1995 | Palmer | E02D 27/02 249/40 |
| 6,332,599 | B1 * | 12/2001 | Spartz | E02D 27/02 249/33 |
| 6,536,737 | B1 | 3/2003 | Davis | |
| 7,874,112 | B2 * | 1/2011 | Kovatch | E04C 5/16 52/309.1 |
| 8,574,471 | B2 * | 11/2013 | Prater | E04G 13/00 249/155 |
| 2003/0019175 | A1 * | 1/2003 | Kremers | E02D 27/02 52/294 |
| 2008/0104909 | A1 * | 5/2008 | Wallin | E02D 29/0275 52/293.1 |
| 2009/0255199 | A1 * | 10/2009 | Lonsdale | E02D 27/02 52/292 |
| 2014/0015154 | A1 * | 1/2014 | Hogan | E04G 13/00 264/31 |

* cited by examiner

PERMANENT SHALLOW FROST PROTECTED FOOTING FOUNDATION FOR A BUILDING AND METHOD FOR CONSTRUCTING A FOUNDATION INCLUDING A PERMANENT SHALLOW FROST PROTECTED FOOTING

BACKGROUND

The preparation and construction of a building foundation is an elaborate process that involves setting up footing forms to below frost line, and building a concrete wall on top of the footing to above ground level on which will rest the walls of the building. The frost line—also known as frost depth or freezing depth—is most commonly the depth to which the groundwater in soil is expected to freeze. The frost depth depends on the climatic conditions of an area, the heat transfer properties of the soil and adjacent materials, and on nearby heat sources. The line varies by latitude; it is deeper closer to the poles. It ranges in the United States from about zero to six feet.

A footing installed above the frost line may heave as ground below it freezes and thaws in cold weather wracking and twisting the structure that is built upon it. An unprotected footing in the US may need to be placed as much as 72" below ground level to protect the footing from wracking due to the freezing and expansion of the earth that supports the footing. Usually the steps for building the footing and foundation take several days, large excavation machinery and extensive excavation to achieve the appropriate excavation width and footing depth below frost line even if it is for a footing for an outside building such as a garage, greenhouse or sunroom.

Footing excavations generally need to be 30"-36" wide in order to accommodate construction of the typical 16"-24" wide by 8-10" high footing. The concrete foundation walls that will support the above ground structure are then formed and poured on top of the new footing after the footing has cured for typically a couple of days. These foundation walls are generally 6" to 8" thick and run around the entire perimeter of the structure.

SUMMARY

According to a first aspect of the present invention, a form part is provided comprising insulating foam material shaped as an elongated sectional unit with an overhang part and an interior boot shaped cavity having a foot cavity part formed opposite the overhang part, the interior boot shaped cavity also having a throat opening part, wherein the sectional unit is formed with open ends.

In accordance with the first aspect of the present invention, the overhang part may have a foot shape that fits inside a foot cavity part of another form part comprising insulating foam material shaped as an elongated sectional unit. A toe of the foot shaped overhang part may be truncated so as to form a wall of the throat opening part of the boot shaped cavity.

According to a second aspect of the present invention, an article of manufacture is provided comprising a sectional form unit having a shape that is on an outside surface shaped as a u-shaped channel with a channel bottom leg joined to a long channel leg and to an opposite short channel leg that are each perpendicular to said bottom leg on said outside surface of said unit with said long channel leg having a uniform thickness and with said short channel leg having a non-uniform thickness that is thinnest where the short channel leg joins the bottom channel leg and thickest at a top end of said short channel leg so as to form an inner wall of an opening of said unit, said short channel leg formed with a flat top end that is wider than formed at a flat top end of said long channel leg so as to altogether form a cavity within said sectional form unit that has, in a cross section perpendicular to a longitudinal axis of said sectional form unit, a wider cavity part adjacent the channel bottom leg and a narrower cavity part extending from said wider cavity part to said opening of said unit.

In accordance with the second aspect of the present invention, said sectional form unit may be assembled for shipment to a construction site so as to nest with another sectional form unit by mating said short channel leg of each sectional form unit inside a wider shaped cavity of the other sectional form unit and disassembled at the construction site for assembly into a sectional part of a permanent concrete form part of a permanent frost protected shallow foundation footing for a building.

In further accordance with the second aspect of the present invention, the article of manufacture may have opposing ends formed for abutment with adjacent sectional form units in end to end alignment with each other to form a chain of sectional form units set partially below ground level and partially above ground level so as to form a permanent concrete form part of a permanent frost protected shallow foundation footing for a building.

In further accordance with the second aspect of the present invention, said flat top end of said long channel leg may have a length selected to match a top surface level of a concrete floor of a foundation for a building relative to a bottom surface level of said concrete floor. The opposing ends formed for abutment with adjacent sectional form units in end to end alignment with each other may be formed into a chain of sectional form units set partially below ground level and partially above ground level so as to form said permanent concrete form part of said permanent frost protected shallow foundation footing for said building.

In further accordance with the second aspect of the present invention, said flat top end of said longer channel leg may be formed to accept a channel cap slid over said top end of said longer channel leg and over a top end of at least one adjacent form unit to keep the form unit aligned with said at least one adjacent form unit before, during and after construction of said permanent frost protected shallow foundation footing and as a protective cap over said top end with one side extending from said top end on an outside surface of said longer channel leg toward said bottom channel leg to protect at least part of said outside surface of said longer leg and with another side extending from said top end on an inside surface of said longer channel leg a distance toward said bottom channel leg to form an inner side of said cap to hold said cap in place over said top end.

In further accordance with the second aspect of the present invention, said flat top end of said longer channel leg is formed to accept a channel cap slid over said top end of said longer channel leg and over a top end of at least one adjacent form unit to keep the form unit aligned with said at least one adjacent form unit before, during and after construction of said permanent frost protected shallow foundation footing and as a protective cap over said top end with one side extending from said top end on an outside surface of said longer channel leg toward said bottom channel leg to protect at least part of said outside surface of said longer leg and with another side extending from said top end on an inside surface of said longer channel leg a distance toward said bottom channel leg to form an inner side of said cap to hold said cap in place over said top end.

According to a third aspect of the present invention, a method is provided comprising constructing a foundation for a building at a building site, said foundation comprising a permanent frost protected shallow foundation footing for said building, said method comprising:

assembling a plurality of sectional form units each made from a solid lightweight insulating material that is transported to the building site, said plurality of sectional form units assembled to form sectional parts of a permanent concrete form part of said permanent frost protected frost protected shallow foundation footing for said building, said sectional form units assembled so as to fit in a chain of sectional form units set partially below ground level and partially above ground level alongside each other to form said chain of sectional form units as said concrete form part of said permanent frost protected shallow foundation footing for said building, each sectional form unit having an interior cavity with opposite end openings in exterior ends of said sectional form unit, said sectional form unit assembled with said plurality of sectional form units with said end openings in said opposite exterior ends aligned with end openings in adjacent sectional form units in end-to-end abutment with said two opposite exterior ends to form an elongate interior cavity within said chain of sectional form units, and pouring concrete through a pour opening of each sectional form unit, said pour opening for receiving said concrete pour, said pour at least in part filling said interior cavity assembled with said plurality of sectional form units assembled into said chain of sectional form units into said elongate interior cavity within said chain of sectional form units, said concrete pour at least in part filling said interior cavity when assembled with said plurality of sectional form units to form a concrete link of a concrete part of said permanent frost protected shallow foundation footing in said elongate interior cavity within said chain of sectional form units, said concrete pour overflowing from within said interior cavity through said pour opening to connect outside said plurality of sectional form units with a further/concurrent concrete pour of a floor for said building having a floor periphery bounded at least in part by said chain of sectional form units of said permanent concrete form part of said permanent frost protected shallow foundation footing, said floor poured at least in part after said pour of said concrete part of said permanent frost protected shallow foundation footing in said elongate interior cavity within said chain of said sectional form units.

According to a fourth aspect of the present invention, a foundation for a building is provided, said foundation comprising a permanent shallow frost protected footing foundation for said building, comprising:

an assembly of sectional form units each made from a solid lightweight insulating material that is transported to the building site, said plurality of sectional form units assembled to form sectional parts of a permanent concrete form part of said permanent frost protected shallow foundation footing for said building, said sectional form units assembled so as to fit in a chain of sectional form units set partially below ground level and partially above ground level alongside each other to form said chain of sectional form units as said concrete form part of said permanent frost protected shallow foundation footing for said building, each sectional form unit having an interior cavity with opposite end openings in exterior ends of said sectional form unit, each sectional form unit assembled with said plurality of sectional form units with said end openings in said opposite exterior ends aligned with end openings in adjacent sectional form units assembled in end-to-end abutment with said two opposite exterior ends to form an elongate interior cavity within said chain of sectional form units; and concrete that was poured through a pour opening of each sectional form unit into said elongate interior cavity in said assembly of plural sectional form units assembled into said chain of sectional form units so as to at least in part fill said elongate interior cavity within said chain of sectional form units to form a concrete part of said permanent frost protected shallow foundation footing in said elongate interior cavity within said chain of sectional form units, said concrete pour overflowing from within said elongate interior cavity through said pour openings to connect outside said plurality of sectional form units with a further concrete pour of a floor for said building having a floor periphery bounded at least in part by said chain of sectional form units of said permanent concrete form part of said permanent frost protected shallow foundation footing, said floor poured at least in part after said pour of said concrete part of said permanent frost protected shallow foundation footing in said elongate interior cavity within said chain of said sectional form units.

According to a fifth aspect of the present invention, an article of manufacture is provided comprising a sectional form unit made from a solid lightweight insulating material that is transportable to a construction site for assembly as a sectional part of a permanent concrete form part of a permanent frost protected shallow foundation footing for a building, said sectional form unit for said assembly with a plurality of sectional form units cut to fit in a chain of sectional form units set partially below ground level and partially above ground level alongside each other to form said chain of sectional form units as said form part of said permanent frost protected shallow foundation footing for said building, said sectional form unit having an interior cavity with opposite end openings in exterior ends of said sectional form unit, said sectional form unit for said assembly with said plurality of sectional form units with said end openings in said opposite exterior ends aligned with end openings in adjacent sectional form units assembled in end-to-end abutment with said two opposite exterior ends to form an elongate interior cavity within said chain of sectional form units, said interior cavity of said sectional form unit having said pour opening for receiving said concrete pour to at least in part fill said interior cavity when assembled with said plurality of sectional form units to form said concrete link of said concrete part of said permanent frost protected shallow foundation footing in said elongate interior cavity within said chain of sectional form units, said concrete poured to at least in part fill said interior cavity of said sectional form unit and to overflow from within said interior cavity through said pour opening to connect outside said plurality of sectional form units with a concurrent pour of a concrete floor for said building having a floor periphery bounded at least in part by said chain of sectional form units, said floor poured at least in part after said pour of said permanent concrete part of said permanent frost protected shallow foundation footing in said elongate interior cavity within said chain of said sectional form units.

In accordance with the fifth aspect of the present invention, said interior cavity may be formed as a boot-shape with a foot cavity part and a leg cavity part, said foot cavity part formed with interior cavity walls shaped as a foot top part interior wall and a foot bottom part interior wall joined at an acute angle as a toe shaped joining of said foot top part interior wall and said foot bottom part interior wall of said foot cavity part of said interior cavity, said foot bottom part interior wall formed opposite an exterior bottom side of said elongate sectional unit, said foot bottom part interior wall joined at a right angle at a heel shaped joining in said interior cavity to a back interior wall of said leg cavity part opposite to an exterior rear side of said elongate sectional unit, said back interior wall extending to said pour opening in an exterior top side of said elongate sectional unit comprising a leg cavity part opening, a front part of said interior wall of said leg part joined at an obtuse angle to said foot top part interior wall of said foot cavity part of said interior cavity, said foot top part interior wall of said interior cavity forming an interior cavity side wall of an overhang section of an exterior front side of said elongate sectional unit and said exterior top side of said elongate sectional unit that includes an exterior top side wall of said overhang section, said toe shaped joining of said foot top part interior wall and said foot bottom part pointing toward said exterior front side joining said exterior top side wall of said overhang section to said exterior bottom side, said exterior bottom side joined to said exterior rear side, said exterior rear side and said interior wall of said leg part extending beyond said front part of said interior wall of said leg cavity part to form a part of said sectional unit that juts out as a backstop to said concrete poured into said pour opening in said exterior top side.

According to a sixth aspect of the present invention, a foundation part is provided comprising a sectional unit formed from a lightweight insulating material with an interior cavity extending between opposite open ends of said sectional unit, said interior cavity having a boot-shape with a foot cavity part and a leg cavity part, said foot cavity part shaped with interior cavity walls forming a foot top part, a foot bottom part and a heel rear part, said leg cavity part having an interior wall extending from said heel rear part of said foot cavity part to a leg cavity part opening of said sectional unit, a front part of said interior wall of said leg part joined at an obtuse angle to an interior foot top wall of said foot cavity part of said interior cavity, said interior foot top wall of said interior cavity forming a cavity side wall of an overhang section of said sectional unit that includes an exterior top side wall of said overhang section, said foot top wall of said interior cavity joined at an acute angle to a foot bottom wall of said interior cavity to form a toe front part of said interior cavity extending toward an exterior wall of said sectional unit joining said exterior top side wall of said overhang section to an exterior bottom wall of said sectional unit opposite said foot bottom wall, said exterior bottom wall joined to an exterior wall of said sectional unit opposite said back part of said interior wall of said leg part extending beyond said front part of said interior wall of said leg cavity part to form a part of said sectional unit that juts out as a backstop to said opening across from said top side wall of said overhang section.

In accordance with the sixth aspect of the present invention, the foundation part may be a part of a concrete form part of a permanent frost protected shallow foundation footing for a building, said sectional unit for assembly with a plurality of sectional units in a chain of sectional units set partially below ground level and partially above ground level alongside each other requiting minimal site excavation to form said chain of sectional units as said concrete form part of said permanent frost protected shallow foundation footing for said building, said sectional unit having said interior cavity extending between opposite open ends of said elongate sectional unit with said opposite open ends comprising opposite end openings in exterior ends of said sectional unit, said sectional unit for said assembly with said plurality of sectional units with said end openings in said opposite exterior ends aligned with end openings in adjacent sectional units assembled in end-to-end abutment with said two opposite exterior ends to form an elongate interior cavity within said chain of sectional units, said leg cavity opening of said sectional unit comprising a pour opening for receiving a concrete pour to at least in part fill said interior cavity when assembled with said plurality of sectional units to form a concrete link of a concrete part of said permanent frost protected shallow foundation footing in said elongate interior cavity within said chain of sectional units, said concrete poured to at least in part fill said interior cavity of said sectional unit and to overflow from within said interior cavity through said pour opening to connect outside said plurality of sectional units with a concurrent pour of concrete a floor for said building having a floor periphery bounded at least in part by said chain of sectional units, said floor poured at least in part after said pour of said concrete part of said permanent frost protected shallow foundation footing in said elongate interior cavity within said chain of said sectional units.

Frost protection as taught herein is an important aspect of the invention. Minimal excavation and site disturbance is an important benefit, smaller machines like a bobcat loader is sufficient for all prep work and grading. A sunroom addition would enjoy much less lawn and site disturbance with this system than with a standard footing and poured wall. Foundation and floor can be poured concurrently which is a very efficient method as compared to standard systems used today with tremendous savings in time and labor, weather risks etc. As also taught herein the lightweight construction material the forms are made from may be an insulating foam material.

These and other objects, features and advantages of the present invention will become more apparent in light of the detailed description of a best mode embodiment thereof, as illustrated in the accompanying drawing.

DETAILED DESCRIPTION

Figure 1:
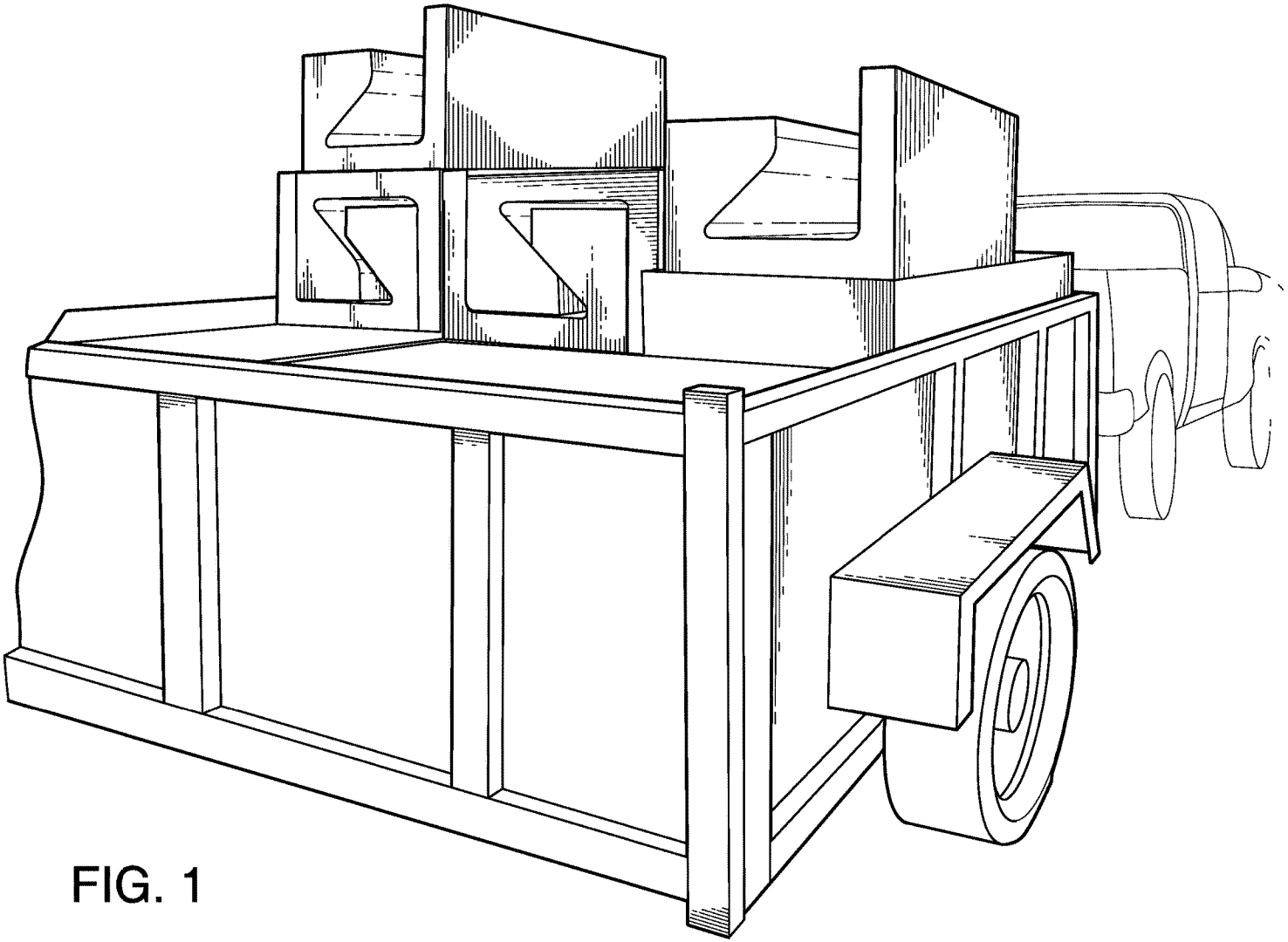
FIG. 1 shows an embodiment of the method of the present invention where a plurality of sectional form units, made according to the present invention, have been delivered by a truck to a construction site and partially unpacked and unloaded.

FIG. 1 shows an embodiment of the present invention where a plurality of sectional form units have been delivered by a truck to a construction site and partially unpacked and unloaded. The illustrated sectional form units are shaped so that at least some of the sectional form units have previously been assembled for shipment to the construction site so as to nest within another sectional form unit as shown by mating in the manner pictured. It is expected that the ability to nest the units together allows shipping costs to be significantly reduced by taking up less space. The units need not all be of the same dimensions. According to embodiments of the present invention, sectional form units, whether formed for nesting in the manner shown or not, are assembled as sections of a permanent frost protected shallow foundation footing for a building as described in a non-limiting example below.

Figure 2:
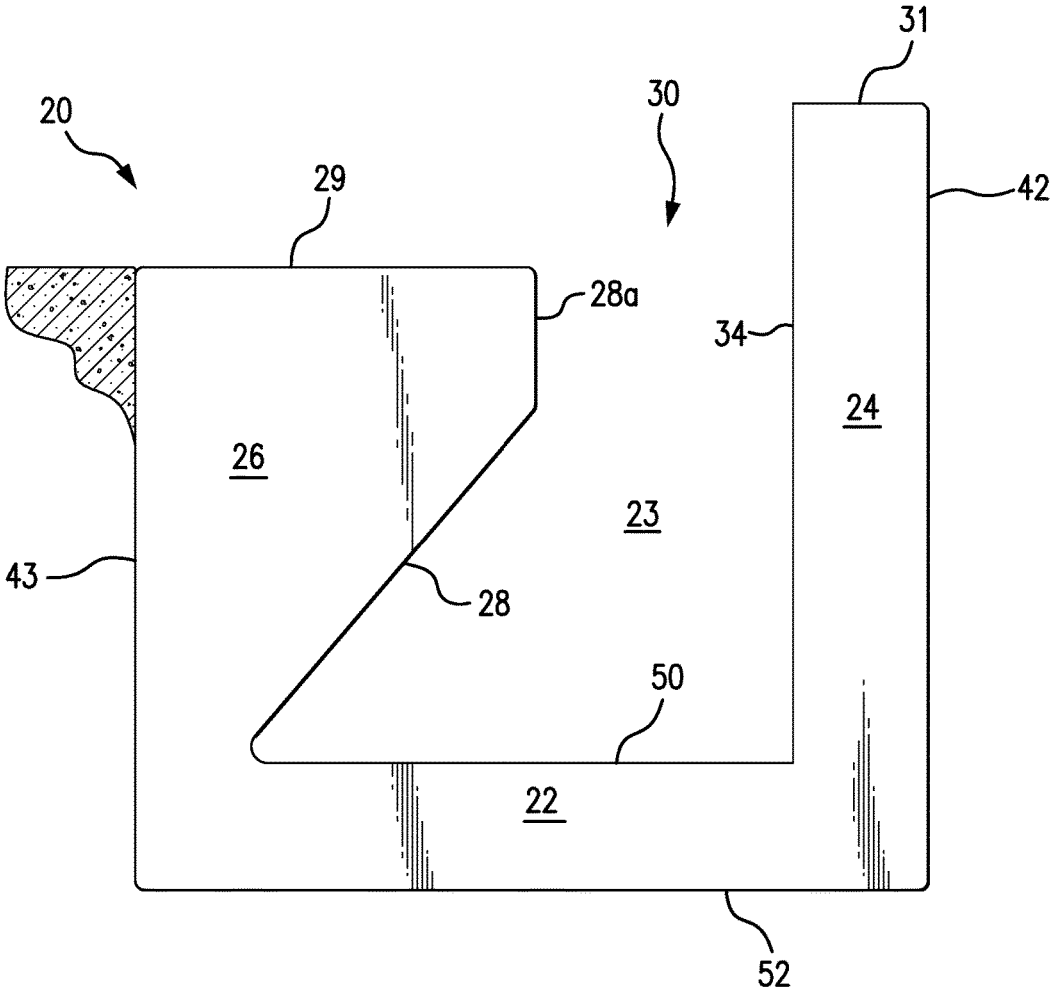
FIG. 2 is a cross sectional view (not to scale) of one of the elongate sectional form units of FIG. 1 as viewed along a longitudinal axis thereof

FIG. 2 shows an end view (not to scale) of one sectional form unit 20 of the exemplary sectional form units of FIG. 1. Each such unit may be made as a form part from insulating foam material and shaped as an elongated sectional unit with an overhang part and an interior boot shaped cavity having a foot cavity part formed opposite the overhang part. The interior boot shaped cavity may also have a throat opening part and the sectional unit may be formed with open ends. The overhang part may have a foot shape so as to in effect constitute a foot part that fits inside a foot cavity part of another form part also comprising insulating foam material shaped as an elongated sectional unit.

The sectional unit of FIG. 1 may be formed from any suitable lightweight insulating construction material as an article of manufacture. Such a construction material could be, for example, an insulating foam material such as synthetic resin foam and a unit or units cut from a solid length of the material having a square or rectangular cross section. The sectional form unit of FIG. 2 has on an outside surface thereof the shaped of a u-shaped channel with a channel bottom leg 22 joined to a long channel leg 24 and to an opposite short channel leg 26 that are each perpendicular to the bottom leg on the outside surface of the unit. The long channel leg may have a uniform thickness and the short channel leg a non-uniform thickness that is thinnest where the short channel leg joins the bottom channel leg and thickest at a top end 29 of the short channel leg so as to form an inner wall 28 of a cavity 23 within the sectional form unit 20. The short channel leg 26 is formed with the flat top end 29 that is wider than formed at a flat top end 31 of the long channel leg. The cavity 23 within the sectional form unit has, in the cross sectional view shown (perpendicular to a longitudinal axis of the sectional form unit), a wider cavity part adjacent the channel bottom leg and a narrower cavity part extending from the wider cavity part to an opening 30 of the cavity. The cavity 23 is shown having a boot shape with an upper part of the cavity having a boot leg opening shape formed by an upper part 28*a* of the inner wall 28 that is formed to be parallel to an opposite inner wall 34 of the long channel leg. The upper part 28*a* of the inner wall 28 may be formed by truncation or cutting off a toe of the foot shaped overhang part 26 so the remaining flat surface forms an inner wall of a throat opening part of the boot shaped cavity.

The dimensions of the sectional form unit of FIG. 2 may selected for a given building and custom made or may be manufactured in advance with a number of different preselected sizes made available. The long channel leg 24 may for instance have its length selected to match a top surface level of a concrete floor of a foundation for a building relative to a bottom surface level of the concrete floor as explained more fully below. See FIG. 13 for example cross sectional dimensions of a selected sectional form unit. The elongated length of the unit (perpendicular to FIG. 2) is made in various selected lengths to suit different possible applications.

As shown in FIG. 1, the sectional form unit 20 of FIG. 2 may be assembled for shipment to the construction site so as to nest with another sectional form unit of the same size (see also FIG. 14) by mating the short channel leg 26 of the sectional form unit inside the cavity 23 of the other sectional form unit and disassembled at the construction site for assembly into a sectional part of a permanent concrete form part of a permanent frost protected shallow foundation footing for a building.

Figure 3:
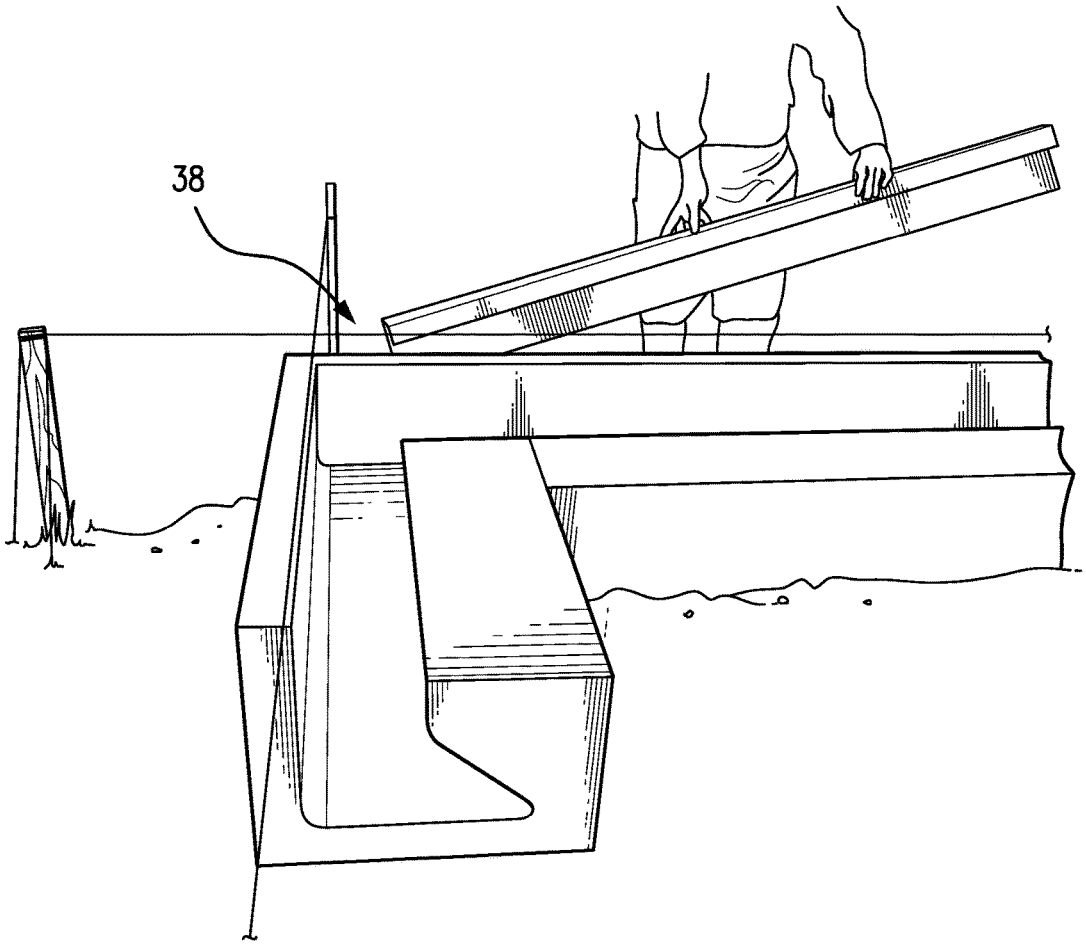
FIG. 3 shows a corner of a foundation laid out on the ground during the construction thereof, before surrounding earth or crushed stone is moved into place, where the corner is shown being formed for instance by first removing material from two units to form angled mating surfaces cut-to-fit on site.

The article of manufacture of FIGS. 1 and 2 may have opposing ends with flat surfaces formed for abutment with adjacent sectional form units in end to end alignment with each other to form a chain of sectional form units to be set partially below ground level and partially above ground level so as to form a permanent concrete form part of a permanent frost protected shallow foundation footing for a building. Such a foundation will typically be laid out in a rectangular shape on the ground with very little excavation or site prep work required as shown in part in FIG. 3, before surrounding earth or crushed stone is moved into place, where a corner 38 is shown being formed for instance by first removing material from two units to form angled mating surfaces cut-to-fit on site. This may be done for instance as shown, by cutting off the ends of two units, in part, at a forty-five degree angle so as to enable an angled mating of the cut faces with an adjoining unit similarly cut so as to form a matching corner unit. One or more insert pieces may be cut to fill gaps at the corners such as a triangular piece shown on the inside corner of the partial assembly of FIG. 3. Such may also be pre-fabricated or joined to form a corner or other change of course of a foundation perimeter in some other way that is customized on the spot or in the factory. On-site custom adaptation is made easy by the ease of cutting the lightweight construction material from which the sectional form unit is made.

Figure 4:
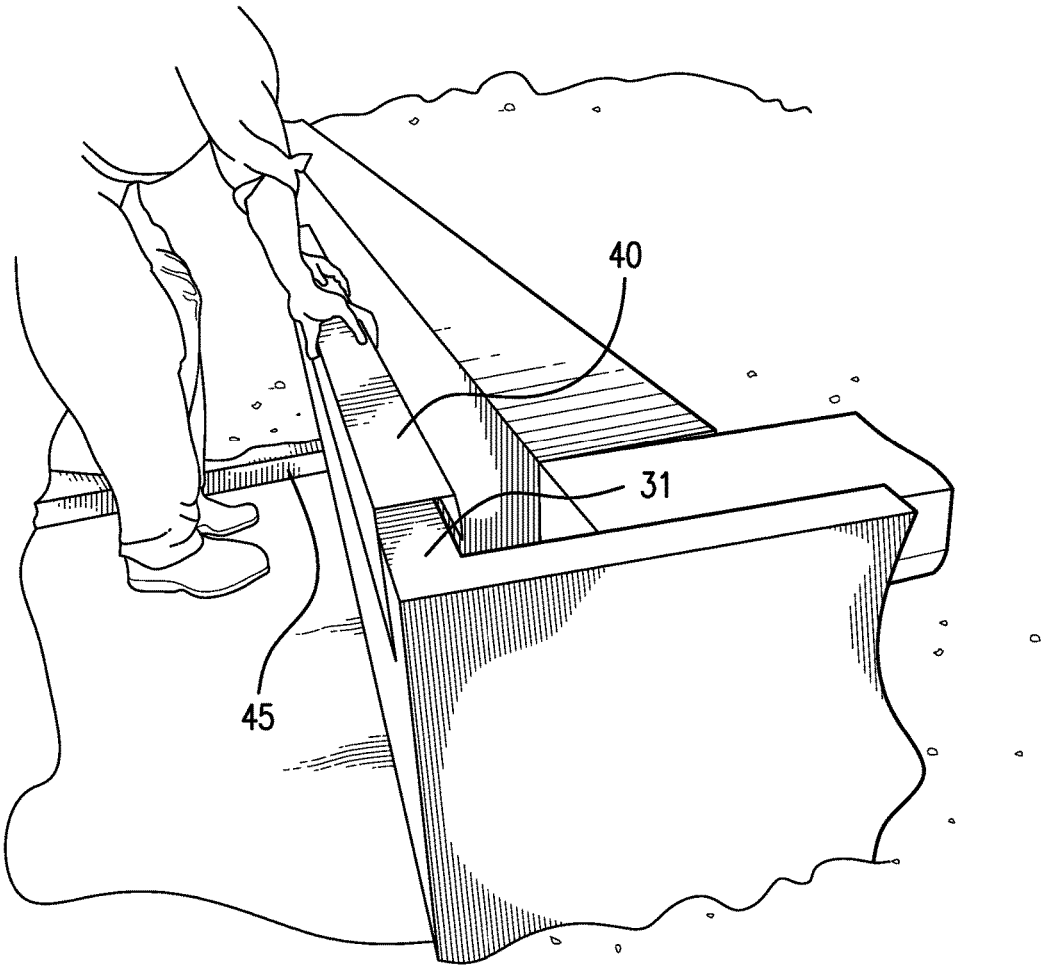
FIG. 4 shows how the sectional units may be joined together and aligned by a formed metal or plastic liner channel/cap.

As shown in FIG. 4, the flat top end 31 of the longer channel leg 24 may be formed as shown in FIG. 2 with a rectangular shape that is ready to accept a channel cap 40 slid over the top end 31 of the longer channel leg 24 and (if available or appropriate) over a top end of at least one adjacent form unit to keep the form unit aligned with the at least one adjacent form unit before, during and after construction of the permanent frost protected shallow foundation footing. It may also serve as a protective cap over the top end with one side extending from the top end on an outside surface 42 of the longer channel leg 24 toward the bottom channel leg 22 to protect at least part of the outside surface of the longer leg 24 and with another side extending from the top end on an inside surface of the longer channel leg a distance toward the bottom channel leg to form an inner side of the cap 40 to hold the cap in place over the top end 31. As shown, one side of the cap channel may have a shorter cap leg for facing the top end of the inner side wall 34 of the longer channel leg 24 of the unit 20. The cap may for instance be formed from an eight foot length of sheet metal. Or, it may be made of plastic. As explained above, the sectional units may be joined together and aligned by the formed metal or plastic liner channel/cap 40. As will be made apparent below, the channel/cap 40 may act to serve as a floor screeding guide during floor leveling and finishing operations. As suggested above, the sectional form unit can be custom made to accommodate different desired concrete floor thickness for instance 4, 5, or 6 inch thickness by changing the height of the outside top end 31 of the longer channel leg 24 relative to the bottom of the concrete floor level. The protective cap 40 allows the screed to ride along the cap as a guide and produce a finished floor flush to the top 31 of the form to the desired thickness. The channel/cap liner 40 also serves to protect the lightweight construction material from which the form 20 is made, e.g., foam on the outside wall 42 of the footing form 20 that would otherwise remain exposed above finished grade level and therefore is protected from being exposed to the elements as shown below.

Figure 5:
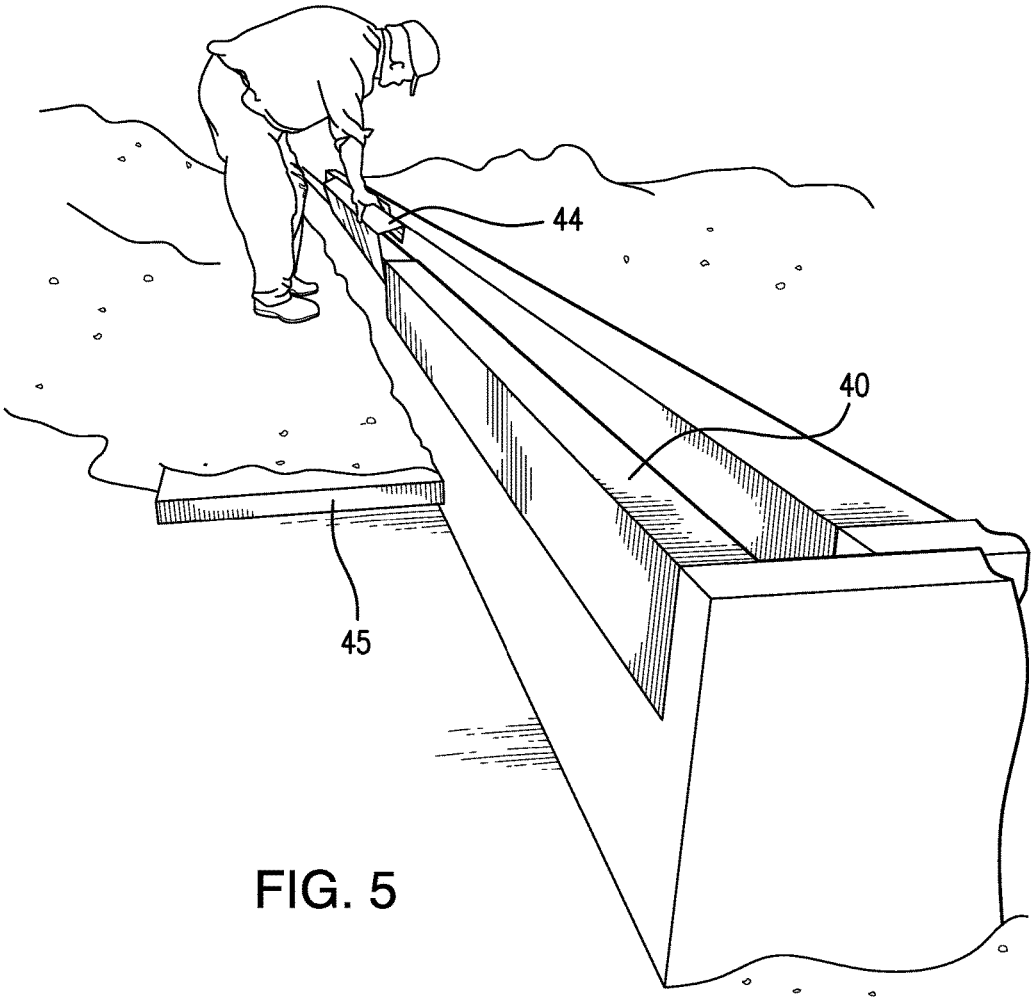
FIG. 5 shows the exemplary panel 42 of FIG. 4 partially covered by earth as in FIG. 4 with the worker placing another protective cap 44 adjacent to the cap 40 along the length of the footing shown.
Figure 6:
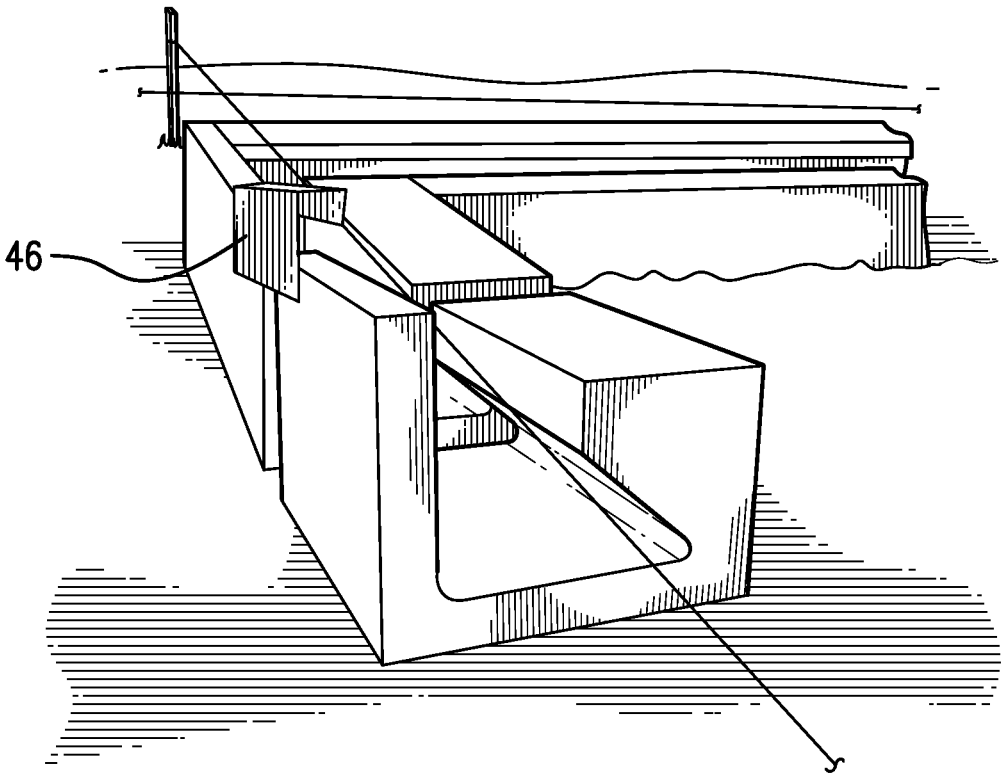
FIG. 6 shows that the channel/cap liner can be made in a shorter length and is shown for illustrative purposes in a position elevated above two adjoining units where it is positions so as to be placed over a joint between two adjoining units that are shown in a still separated position.

FIG. 4 also shows an insulating panel 45 made of the lightweight construction material, such as synthetic resin foam, laid on the ground outside and alongside the outer wall 42 and partially covered with earth during the initial stage of set up. This may be provided to provide a heat barrier outside the perimeter of the foundation to help retard heat transfer, i.e., to retard warmth from below ground level near the footing from rising to the outside during cold weather. The exemplary panel 45 is also shown in FIG. 5 partially covered by earth along with a worker placing another protective cap 44 adjacent to the cap 40 to aid in achieving the purposes described above including proper alignment along the length of the footing shown. The channel/cap liner can be made in a shorter length such as the short cap/liner 46 shown in FIG. 6 in a position elevated above two adjoining units where it is shown being about to be placed over a joint between two adjoining units shown in a still separated position for purpose of illustration. In the case shown in FIG. 6, after the two adjoining units are put in place and aligned with the cap 46, longer cap sections may be placed alongside the short cap 46 for serving the protective and guide purposes described above.

Figure 7:
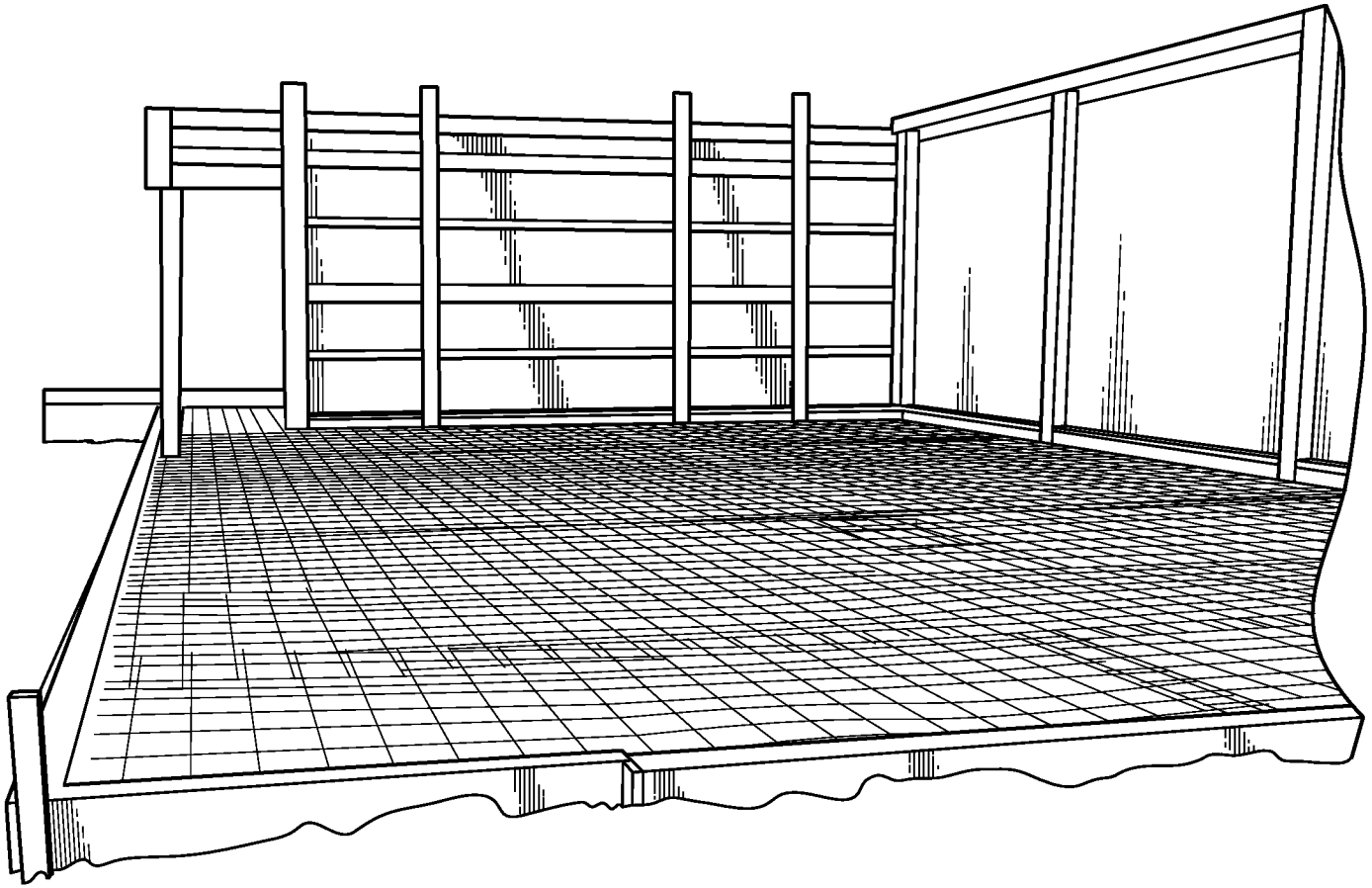
FIG. 7 shows a covering layer of panel type insulation with a steel reinforcing grid laid on top to reinforce the concrete floor to be poured on top.

Once the sectional form units are assembled into the desired foundation footing perimeter and aligned properly for instance with the caps/liners described above, earth and/or crushed rock in the form of small stones or pebbles may be moved and compacted to build up the level of the earth to a desired level outside the perimeter and to fill the inside of the perimeter to a desired depth for instance to a level just below the level of the to end 29 of the short channel legs of the aligned forms. That would allow for placement of a covering layer of lightweight construction material such as synthetic resin foam to be laid over the surface of the earth inside the perimeter up to and in abutment with an outside wall 43 of the short channel leg 26. Or, earth fill can be made so as to be flush and level with the surface of top end 29. That way, the covering layer may extend over the top end 29 and end at the side wall **28*a* of the opening 30 so that the opening is not blocked. FIG. 7** shows such a covering layer with a steel reinforcing grid laid on top to reinforce the concrete floor to be poured on top.

Figure 8:
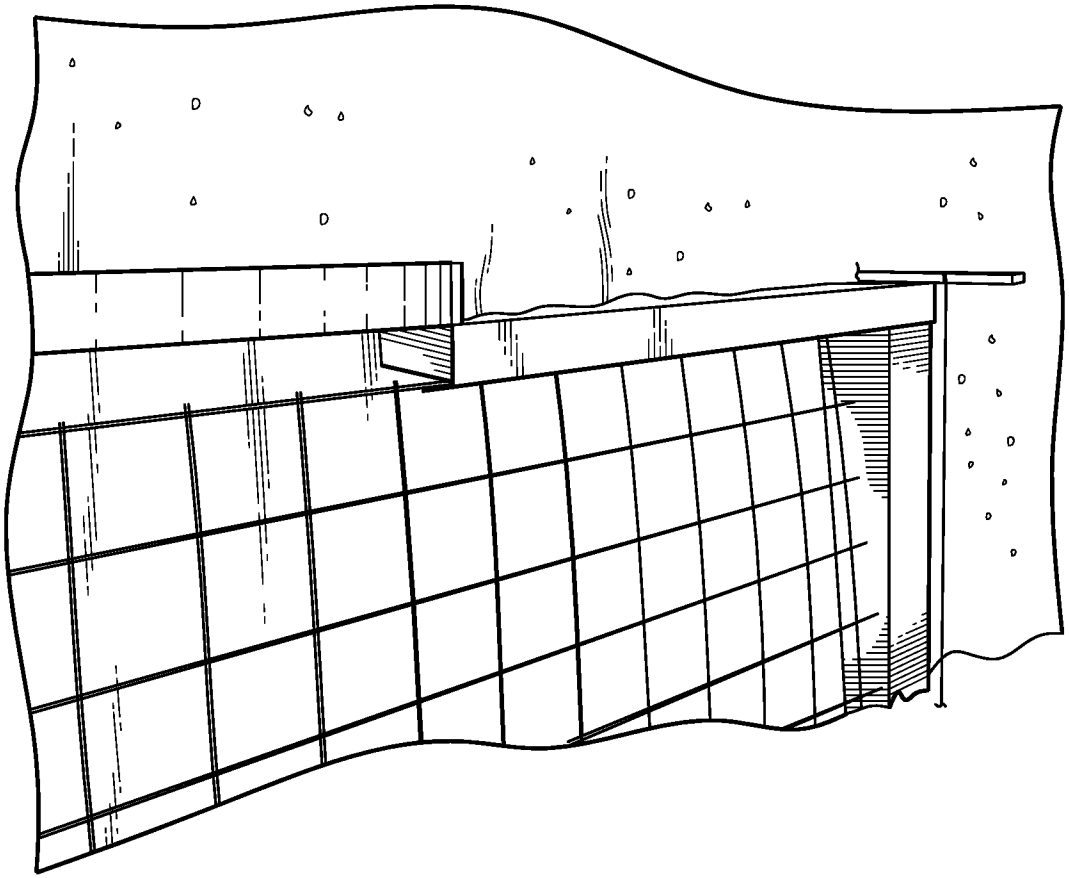
FIG. 8 shows that the sectional form units may be shifted out of perfect alignment relative to the main line of the perimeter so as to make provision for a structural feature such as an extended entrance/exit sill for a door.

It is to be noted that the adjoining sectional form units need not necessarily always be aligned along the perimeter in a straight line. Rather, as shown in FIG. 8, one or more sectional form units may be shifted out of perfect alignment relative to the main line of the perimeter so as to make provision for a structural feature such as an extended entrance/exit sill for a door. In that case, the covering layer inside the perimeter can be cut so as to jut out as shown to the extent needed to account for the shift. The amount of the shift may vary but is shown in FIG. 8 as being of a size corresponding to the thickness of the long channel leg. As a result of such a shift, the elongated cavity of the adjoining sectional form units will not be perfectly aligned but there will be a jog along its course and gaps created on both sides that may simply be blocked with earth or crushed stone as the case may be.

From what has been presented above, it will be appreciated that besides the manufactured sectional form unit itself, the present invention covers a new methodology for making a foundation for a building at a building site, the foundation being a permanent frost protected shallow foundation. The method proceeds by assembling a plurality of sectional form units, such as the unit 20 shown in FIG. 2, each made from a solid lightweight insulating construction material, such as insulating foam material that is transported to the building site, as shown in FIG. 1. The plurality of sectional form units are assembled as shown in FIGS. 3-8 to form sectional parts of a permanent concrete form part of a permanent frost protected shallow foundation footing for the building. The sectional form units are assembled so as to fit in a chain of sectional form units as shown in FIG. 7 set partially below ground level and partially above ground level alongside each other with minimal site disturbance to form the chain of sectional form units as the concrete form part of the permanent frost protected shallow foundation footing for the building. A typical sectional form unit in the assembly has an interior cavity 23 with opposite end openings in exterior ends of the sectional form unit. Each such typical sectional form unit is assembled with the plurality of sectional form units with each unit's end openings (in each unit's opposite exterior ends) aligned with end openings in adjacent sectional form units in end-to-end abutment with the two opposite exterior ends to form an elongate interior cavity within the chain of sectional form units (except for cases such as shown in FIG. 8 that involves an offset so that the alignment has a jog that jogs out and back in to form a doorway sill).

Figure 9:
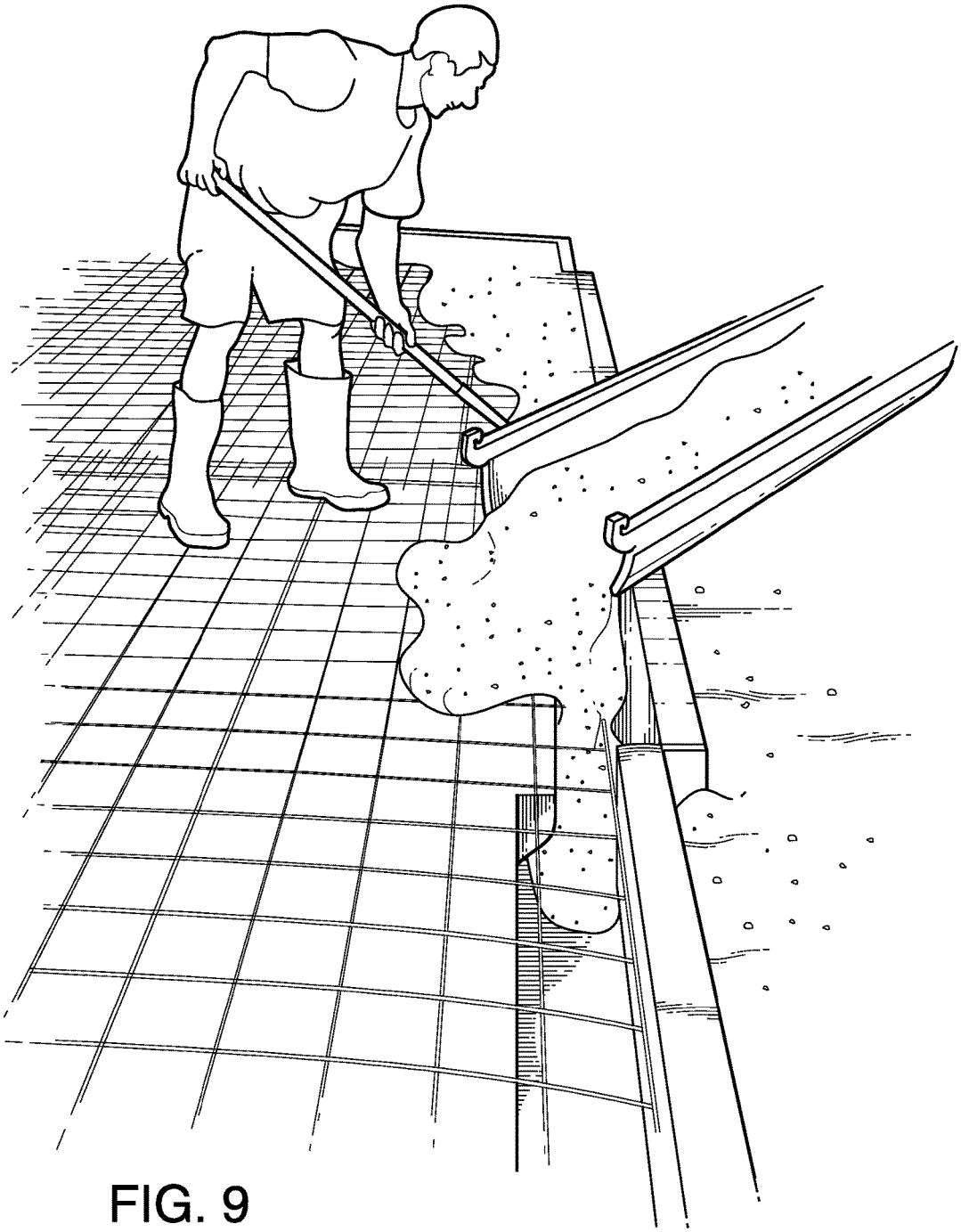
FIG. 9 shows a concrete pour overflowing from within the interior cavity up through the pour opening so as to connect outside the plurality of sectional form units with a further concrete pour of a floor for the building.
Figure 10:
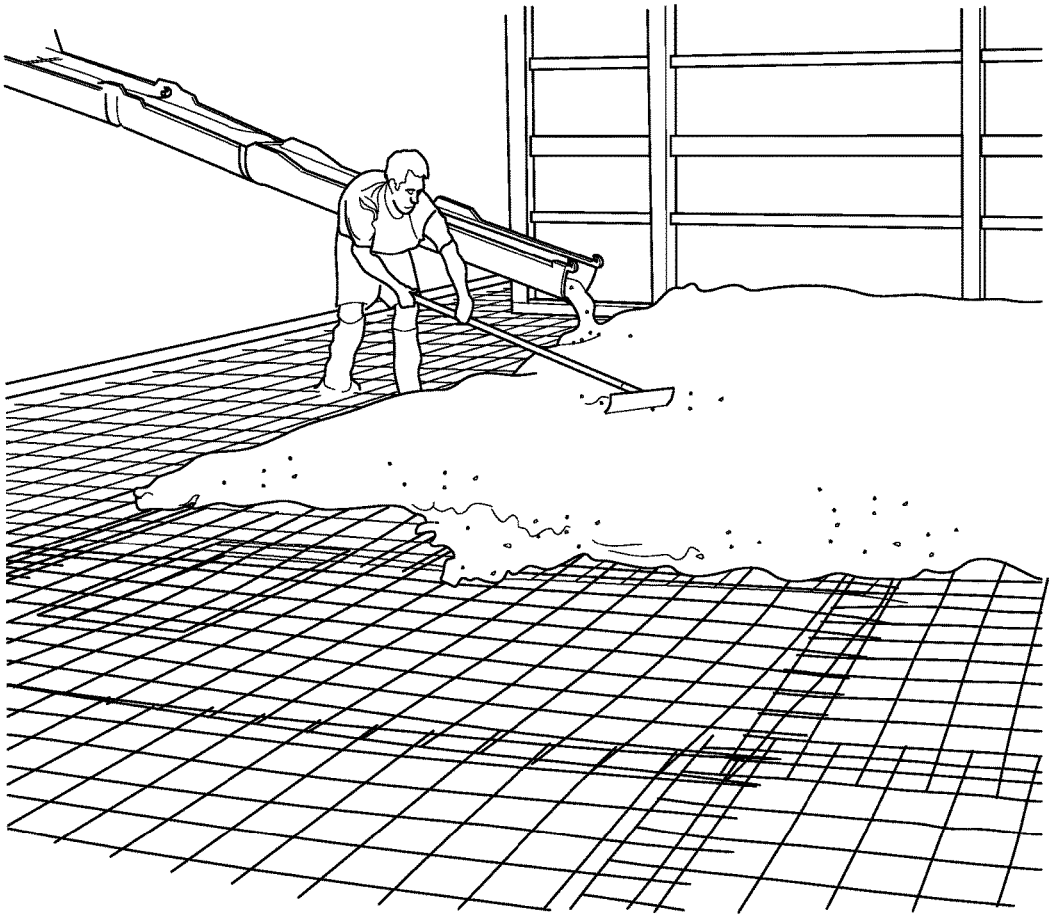
FIG. 10 shows part of the floor poured after the pour of the concrete part of the permanent frost protected shallow foundation footing in the elongate interior cavity within the chain of the sectional form units.
Figure 11:
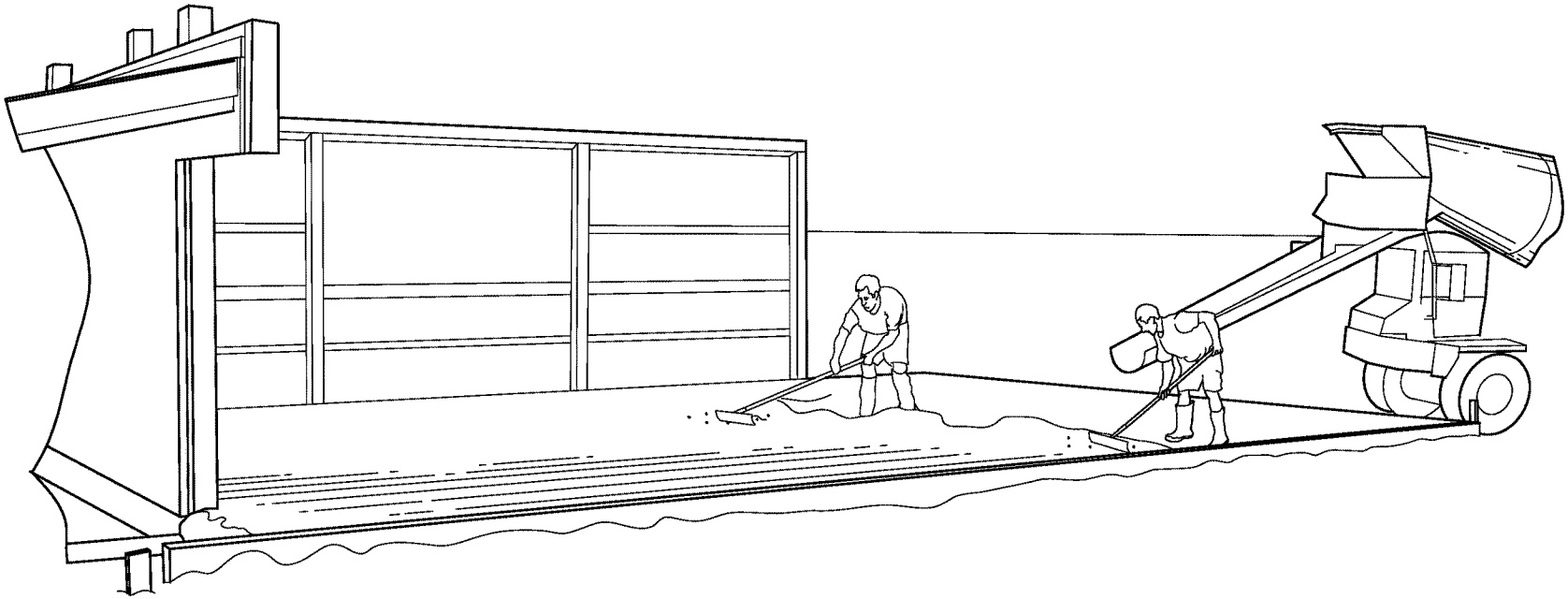
FIG. 11 shows an almost completed floor poured with its level flush with the top of the caps such as the caps 40, 44, 46 described above.

Concrete is then poured, as shown in FIG. 9, through a pour opening 30 of each sectional form unit 20, the pour opening for receiving the concrete pour. The concrete is poured through the throat of the boot shaped cavities so as to at least in part fill each interior cavity 23 within the plurality of sectional form units assembled into the chain of sectional form units, i.e, into an elongated interior cavity within the chain of sectional form units. The efficacy of the concrete pour in filling the cavity may be enhanced by stirring the concrete pour after it is introduced over and through the opening 30 with known tools including powered tools to in effect stir the mix to improve or urge movement in the flow of concrete more fully into the cavity. After hardening, such a concrete pour that at least in part (or as fully as possible) fills the elongate interior cavity formed by the assembled plurality of sectional form units itself forms a concrete link of a concrete part of the permanent frost protected shallow foundation footing (inside the elongate interior cavity within the chain of sectional form units). The concrete pour is shown in FIG. 9 overflowing from within the interior cavity up through the pour opening 30 so as to connect outside the plurality of sectional form units with a further concrete pour of a floor for the building having a floor periphery bounded at least in part by the chain of sectional form units of the permanent concrete form part of the permanent frost protected shallow foundation footing. The floor is then further poured as shown in FIG. 10, at least in part after the pour of the concrete part of the permanent frost protected shallow foundation footing in the elongate interior cavity within the chain of the sectional form units. FIG. 11 shows an almost completed floor poured with its level flush with the top of the caps such as the caps 40, 44, 46 described above.

As described above, in referring to FIG. 2, the described article of manufacture 20 constitutes a sectional form unit made from a solid lightweight insulating construction material such as synthetic resin foam that is transportable to a construction site for assembly as a sectional part of a permanent concrete form part of a permanent frost protected shallow foundation footing for a building. The sectional form unit is made for assembly with a plurality of such sectional form units cut to fit in a chain of sectional form units set partially below ground level and partially above ground level alongside each other to form the chain of sectional form units as the form part of the permanent frost protected shallow foundation footing for the building. The sectional form unit has an interior cavity 23 with opposite end openings in exterior ends of the sectional form unit that may be opposite ends. The sectional form unit is made for such an assembly with such a plurality of sectional form units with the end openings in the exterior ends aligned with end openings in adjacent sectional form units. In other words, they are assembled in end-to-end abutment with the two opposite exterior ends to form an elongate interior cavity within the chain of sectional form units, the interior cavity of the sectional form unit having the pour opening for receiving the concrete pour to at least in part fill the interior cavity when assembled with the plurality of sectional form units to form the concrete link of the concrete part of the permanent frost protected shallow foundation footing in the elongate interior cavity within the chain of sectional form units. The concrete is poured to at least in part fill the interior cavity of the sectional form unit and to overflow from within the interior cavity through the pour opening to connect outside the plurality of sectional form units with a concurrent pour of a concrete floor for the building. The floor has a floor periphery bounded at least in part by the chain of sectional form units and is poured at least in part after the pour of the concrete part of the permanent frost protected shallow foundation footing in the elongate interior cavity within the chain of sectional form units.

Figure 12:
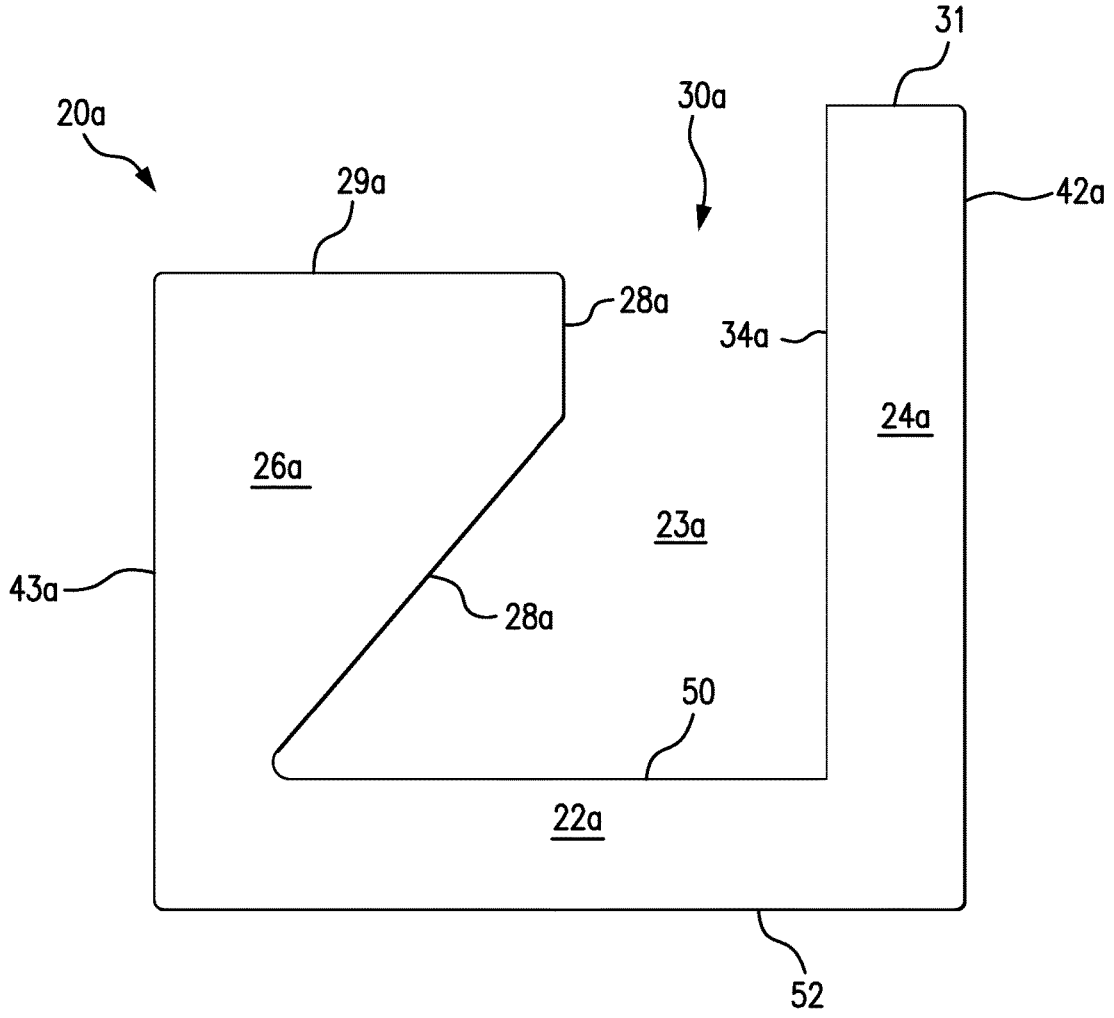
FIG. 12 is the same view as described in connection with FIG. 2 but described with different nomenclature.

FIG. 12 is similar to FIG. 2 except that it uses different reference numerals to describe an article slightly differently. The interior cavity 23*a* of the article of manufacture 20*a* of FIG. 12 may be formed to have a boot-shape with an interior, foot cavity part 23*a* and a leg cavity part extending out of the cavity as in the throat or upper part of a boot. In that case, the foot cavity part is formed with interior cavity walls shaped as a foot top part interior wall 28*a* and a foot bottom part interior wall 50 joined at an acute angle as a toe shaped joining of the foot top part interior wall 28*a* and a foot bottom part interior wall 50 of the foot cavity part of the interior cavity 23*a*. The foot bottom part is an interior wall of a channel bottom leg 22*a* and is formed opposite an exterior bottom side 52 of the bottom leg 22*a* of the elongate sectional unit 20. The foot bottom part interior wall 50 is joined at a right angle at a heel shaped joining in the interior cavity to a back interior wall 34*a* of the leg cavity part opposite to an exterior rear side wall 42*a* of a long channel leg 42*a* of the elongate sectional unit 20*a*. The back interior wall 34*a* extends to a pour opening 30*a* in an exterior top side of the elongate sectional unit 20*a* comprising a leg cavity part opening A front part 28*ab* of the interior wall of the leg cavity part is joined at an obtuse angle to the foot top part interior wall 28*a* of the foot cavity part of the interior cavity 23*a*. The foot top part interior wall 28*a* of the interior cavity 23*a* forms an interior cavity side wall of an overhang section 26*a* having an exterior front side 43*a* on one side of the elongate sectional unit. The exterior top side of the elongate sectional unit 20*a* includes an exterior top side wall 29*a* of the overhang section 26*a*. The toe shaped joining of the foot top part interior wall 28*a* and the foot bottom part 50 points toward the exterior front side 43*a* that joins the exterior top side wall 29*a* of the overhang section 26*a* to the exterior bottom side 52. The interior wall 50 and the exterior wall 52 form internal and external sides of a section 22*a* of the sectional form unit 20*a*. The exterior bottom side 52 is joined to the exterior rear side 42*a* at a right angle. The exterior rear side 42*a* and the interior wall 34*a* of the leg part form internal and external sides of a section 24*a* of the sectional form unit 20*a* that extends beyond the front part 28*ab* of the interior wall of the leg cavity part to form a part of the sectional form unit 20*a* that juts out above the level of the top surface 29*a* of section 26*a* as a backstop to concrete poured into the pour opening 30*a* in the exterior top side of unit 20*a*.

In other words, a foundation part is provided as the sectional form unit 20*a* manufactured from a lightweight construction material such as synthetic resin foam with the interior cavity 23*a* extending between opposite open ends of the sectional unit. The aforementioned open ends are openings having the boot shape of FIG. 12 that is a view along a longitudinal axis (perpendicular to the paper) of the sectional form unit 20*a*. The interior cavity 23*a* has the above-mentioned boot-shape with the lower foot cavity part and the upper leg cavity part as shown. The foot cavity part is shaped with the interior cavity walls as shown forming the foot top part interior wall 28*a*, the foot bottom part interior wall 50 and the heel rear part interior wall 34*a* that also extends out of the cavity to form the upper rear wall of the rear leg part 24*a*. The leg cavity part of cavity 23*a* thus has its back wall 34*a* facing its front wall 28*ab*, with the wall 34*a* extending beyond the leg cavity part as shown extending above the overhang section 26*a*. The wall 34*a* extends all the way from a corner at a lower end of the heel rear part of the foot cavity part, beyond the leg cavity part at the opening 30*a* to the top end 31 of the rear leg part 24*a* of the sectional form unit 20*a*. The front part 28*ab* of the interior wall of the leg cavity part is joined at an obtuse angle to the interior foot top wall 28*a* of the foot cavity part of the interior cavity 23*a*. The interior foot top wall 28*a* of the interior cavity 23*a* forms the cavity side wall of the overhang section 26*a* of the sectional form unit 20*a* that includes the exterior top side wall 29*a* of the overhang section. The foot top wall 28*a* of the interior cavity 23*a* is joined at an acute angle to the foot bottom wall 50 of the interior cavity 23*a* to form a toe front part of the interior cavity 23*a* extending toward the exterior wall 43*a* of the sectional unit 20*a* that joins the exterior top side wall 29*a* of the overhang section to the exterior bottom wall 52 of the sectional unit 20*a* opposite the foot bottom wall 50. The exterior bottom wall 52 is joined to the exterior wall 42*a* of the sectional unit 20*a* opposite the back part 34*a* of the interior wall of the rear leg part 24*a* extending beyond the front part 28*ab* of the interior wall of the leg cavity part to form a part of the sectional unit 20*a* that juts out as a backstop to the opening 30*a* across from the top side wall 29*a* of the overhang section 26*a*. In other words, the leg cavity part has a rear wall 34*a* that is longer than its front wall 28*a* because it forms the backstop part of the leg part 24*a*.

Figure 13:
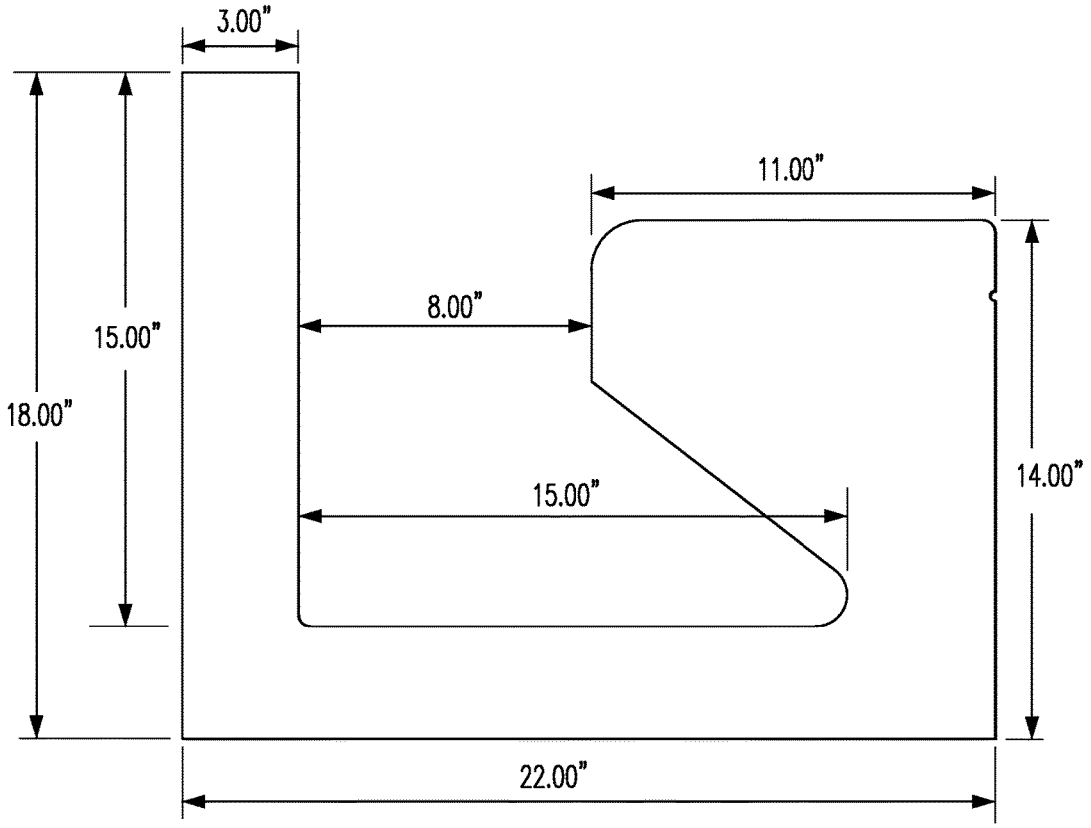
FIG. 13 shows another embodiment of a sectional form unit in cross section with example dimensions shown.

FIG. 13 shows another embodiment of a sectional form unit in cross section with example dimensions shown.

Figure 14:
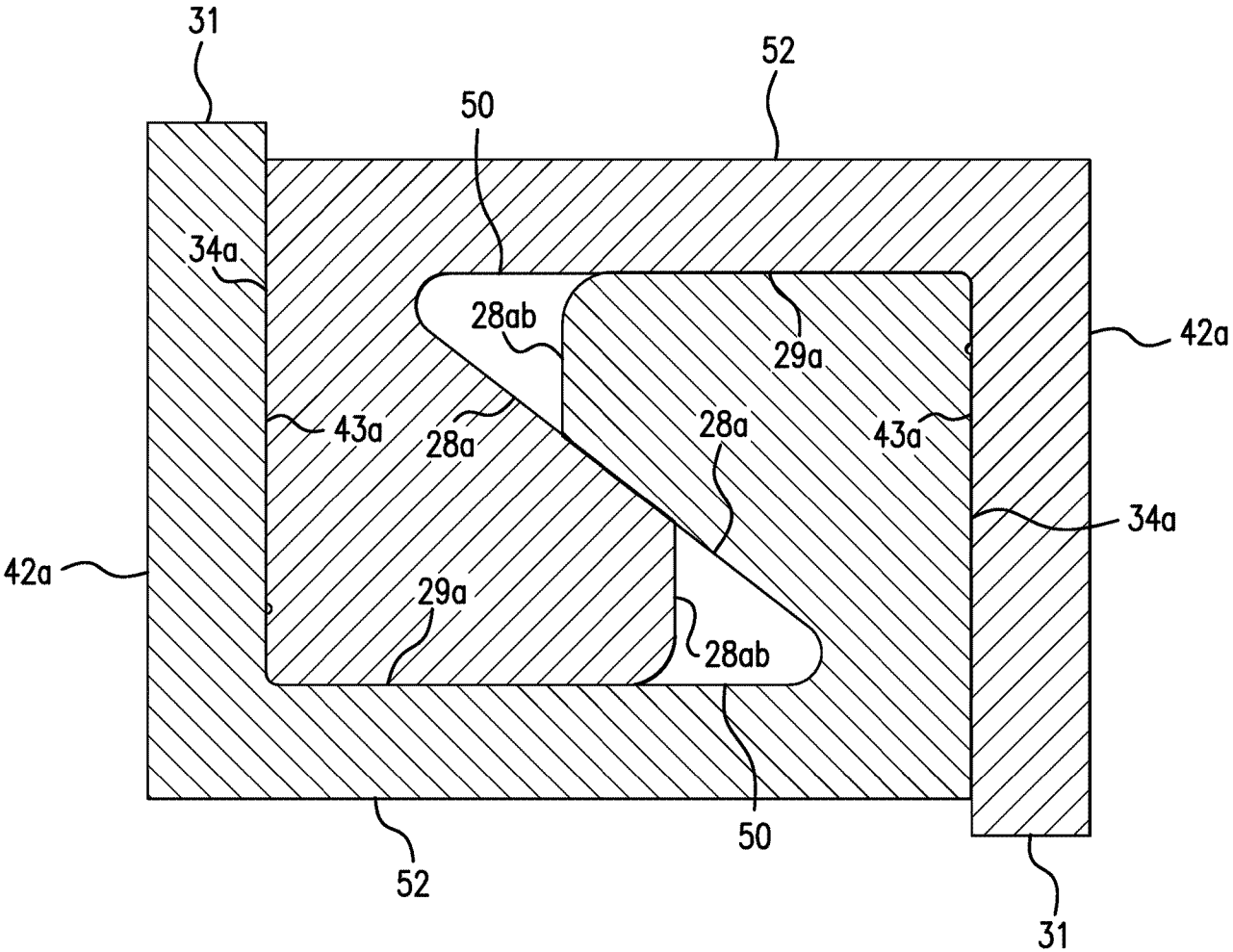
FIG. 14 shows two sectional form units, each made according to the example of FIG. 13, nested together for compactness in shipment to the building site as in FIG. 1.

FIG. 14 shows two sectional form units, each made according to the example of FIG. 13, nested together for compactness in shipment to the building site as in FIG. 1. As shown in FIG. 14, an overhang section of FIG. 13, similar to the overhang section 26*a* of FIG. 12, may be shaped as a foot (with a truncated toe) so as to fit inside the interior cavity 23*a*. In other words, in nesting the two units, the overhang part or section 26*a* is passed through the throat part of the boot and into the foot cavity part so as to neatly fit inside the foot cavity part of the interior cavity 23*a* for compact packaging for storage and/or shipment. In that case, the interior foot top walls 28*a* of the nested units are in part facing each other and cavity toes of the respective units are situated across from truncated toe walls 28*ab* of the other unit. Likewise, respective interior walls 34*a* face exterior walls 43*a*. Interior walls 50 face exterior top side walls 29*a*. Exterior bottom walls 52 of the nested units are situated parallel to each other as are the exterior walls 42*a* to form exteriors of the nested unit assembly. This nested unit assembly makes for a compact way to ship the units and saves a lot of space as will be evident from the delivery of a plurality of nested unit assemblies on a delivery truck in FIG. 1 in the process of being unpacked at the building site.

Although the invention has been shown and described with respect to a best mode embodiment thereof, it should be understood by those skilled in the art that the foregoing and various other changes, omissions and deletions in the form and detail thereof may be made therein without departing from the spirit and scope of this invention. Likewise, although the invention has been shown and described with respect to one or more particular preferred embodiments, it is clear that equivalent amendments or modifications will occur to the person skilled in the art when reading and interpreting the text and enclosed drawing(s) of this specification. In particular with regard to the various functions performed by the elements (components, assemblies, devices, compositions, etc.) described above, the terms used to describe such elements (including any presently or later claimed "means") are intended, unless expressly indicated otherwise, to correspond to any element which performs the specified function of the element described, i.e. which is functionally equivalent to it, even if it is not structurally equivalent to the disclosed structure which performs the function in the example embodiment(s) illustrated here.

Moreover, while a particular feature of the invention may have been described above with respect to only one or some of the embodiments illustrated, such a feature may also be combined with one or more other features of the other embodiments, in any way such as may be desirable or advantageous for any given application of the invention. While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. Furthermore, any means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. A method, comprising constructing a foundation for a building at a building site, said foundation comprising a permanent frost protected shallow foundation footing for said building, said method comprising:

assembling a plurality of sectional form units so as to be set partially below ground level and partially above ground level alongside each other to form abutting sectional form units as concrete forms for said permanent frost protected shallow foundation footing for said building, each form unit formed with open ends, said plurality of section form units assembled with said open ends in abutment with adjacent form units in end to end alignment with each other, each form unit comprising insulating foam material shaped with an overhang part and an interior boot shaped cavity having a foot cavity formed opposite said overhang part, said interior boot shaped cavity also having a throat opening that opens said foot cavity to outside said form unit, wherein a narrower part of said foot cavity extends from a wider part of said foot cavity to said throat opening, said form unit having an outside surface shaped as a u-shaped channel having said interior boot shaped cavity formed within by a channel bottom leg joined to a long channel leg and to said overhang part opposite said long channel leg and shorter than said long channel leg such that said long channel leg and said overhang part are each perpendicular to said bottom leg on said outside surface of said form unit with said long channel leg having a uniform thickness and with said overhang part having a non-uniform thickness that is thinnest where said overhang part joins said bottom channel leg and thickest at a top end of said overhang part so as to form an inner wall of said throat opening of said form unit, said overhang part formed with a flat top end that is wider than formed at a flat top end of said long channel leg, and wherein said foot cavity has, in a cross section perpendicular to a longitudinal axis of said form unit, said wider part of said foot cavity adjacent said channel bottom leg, and pouring concrete through the throat opening of at least one section form unit, said throat opening receiving said concrete pour, said pour at least in part filling said boot shaped cavity in each of said plurality of section form units assembled in end to end alignment with each other.

2. A foundation for a building, said foundation comprising a permanent shallow frost protected footing foundation for said building, comprising:

an assembly of sectional form units set partially below ground level and partially above ground level alongside each other to form said permanent shallow frost protected footing foundation for said building, each form unit comprising insulating foam material shaped with an overhang part and an interior boot shaped cavity having a foot cavity formed opposite said overhang part, said interior boot shaped cavity also having a throat opening that opens said foot cavity to outside said form unit, wherein a narrower part of said foot cavity extends from a wider part of said foot cavity to said throat opening, and wherein said form unit is formed with open ends, said form unit having an outside surface shaped as a u-shaped channel having said interior boot shaped cavity formed within by a channel bottom leg joined to a long channel leg and to said overhang part opposite said long channel leg and shorter than said long channel leg such that said long channel leg and said overhang part are each perpendicular to said bottom leg on said outside surface of said form unit with said long channel leg having a uniform thickness and with said overhang part having a non-uniform thickness that is thinnest where said overhang part joins said bottom channel leg and thickest at a top end of said overhang part so as to form an inner wall of said throat opening of said form unit, said overhang part formed with a flat top end that is wider than formed at a flat top end of said long channel leg, and wherein said foot cavity has, in a cross section perpendicular to a longitudinal axis of said form unit, said wider part of said foot cavity adjacent said channel bottom leg, said sectional form units assembled with said open ends in abutment with adjacent form parts in end to end alignment with each other, each boot shaped cavity filled at least in part with concrete.

* * * * *